US010829345B2

(12) United States Patent
Madera et al.

(10) Patent No.: US 10,829,345 B2
(45) Date of Patent: Nov. 10, 2020

(54) HOLDING DEVICE

(71) Applicant: thyssenkrupp Elevator Innovation and Operations GmbH, Essen (DE)

(72) Inventors: Martin Madera, Neuhausen (DE); Mike Obert, Gernsbach (DE); Martin Krieg, Gaggenau (DE); Sebastian Griesardt, Bietigheim (DE); Ionel Stanica, Bucharest (RO)

(73) Assignee: thyssenkrupp Elevator Innovation and Operations GmbH, Essen (DE)

( * ) Notice: Subject to any disclaimer, the term of this patent is extended or adjusted under 35 U.S.C. 154(b) by 0 days.

(21) Appl. No.: 16/485,309

(22) PCT Filed: Jan. 5, 2018

(86) PCT No.: PCT/EP2018/050265
§ 371 (c)(1),
(2) Date: Aug. 12, 2019

(87) PCT Pub. No.: WO2018/149554
PCT Pub. Date: Aug. 23, 2018

(65) Prior Publication Data

US 2019/0375611 A1 Dec. 12, 2019

(30) Foreign Application Priority Data

Feb. 15, 2017 (DE) ..... 10 2017 202 405

(51) Int. Cl.
*B66B 7/02* (2006.01)
*B66B 9/00* (2006.01)
*B66B 19/00* (2006.01)

(52) U.S. Cl.
CPC ..... *B66B 7/02* (2013.01); *B66B 9/003* (2013.01); *B66B 19/002* (2013.01)

(58) Field of Classification Search
CPC ..... B66B 7/02; B66B 9/003; B66B 19/002
See application file for complete search history.

(56) References Cited

U.S. PATENT DOCUMENTS 3,658,155 A * 4/1972 Salter ..... B66B 11/006 198/798
5,235,144 A * 8/1993 Matsui ..... B66B 9/003 187/250

(Continued)

FOREIGN PATENT DOCUMENTS

CN 103987645 A 8/2014
CN 106223679 A 12/2016

(Continued)

OTHER PUBLICATIONS

English Translation of International Search Report issued in PCT/EP2018/050265, dated Mar. 12, 2018.

*Primary Examiner* — Michael A Riegelman
(74) *Attorney, Agent, or Firm* — William J. Cassin

(57) ABSTRACT

A holding device for holding a rotary platform of an elevator system. The elevator system includes an elevator car movable by way of guide rails; a fixed first guide rail fixedly arranged in a shaft and orientated in a first direction; a fixed second guide rail fixedly orientated in a second direction; and a third guide rail configured to rotate with respect to the shaft, and is secured to the rotary platform and is configured to rotate between an orientation in the first direction and an orientation in the second direction. The holding device includes a shaft mounting configured to secure the holding device to the shaft; a holding frame configured to at least indirectly secure the rotary platform to the holding device; and a first adjustment arrangement configured to adjust the orientation of the holding frame with respect to the shaft mounting.

15 Claims, 4 Drawing Sheets

(56) References Cited

U.S. PATENT DOCUMENTS

| | | | | |
|---|---|---|---|---|
| 6,354,404 | B1 * | 3/2002 | Sansevero | B66B 9/003 187/249 |
| 9,469,506 | B2 * | 10/2016 | Scomparin | B66B 9/16 |
| 2011/0042168 | A1 | 2/2011 | Grundmann | |
| 2014/0190774 | A1 | 7/2014 | Hsu | |
| 2016/0068369 | A1 | 3/2016 | Valkama | |
| 2017/0107080 | A1 * | 4/2017 | Steinhauer | B66B 1/36 |
| 2017/0225927 | A1 * | 8/2017 | Kirsch | B66B 9/00 |
| 2018/0009636 | A1 * | 1/2018 | Jedryczka | B66B 9/003 |
| 2018/0257911 | A1 * | 9/2018 | Gainche | B66B 7/02 |
| 2019/0071285 | A1 | 3/2019 | Kuczera | |
| 2019/0077635 | A1 | 3/2019 | King | |
| 2019/0177125 | A1 * | 6/2019 | Gainche | B66B 7/026 |
| 2019/0375611 | A1 * | 12/2019 | Madera | B66B 7/02 |
| 2020/0002131 | A1 * | 1/2020 | Bauer | G05B 9/03 |
| 2020/0062548 | A1 * | 2/2020 | Gainche | B66B 9/003 |
| 2020/0131001 | A1 * | 4/2020 | Madera | B66B 9/00 |

FOREIGN PATENT DOCUMENTS

| | | | |
|---|---|---|---|
| DE | 10 2015 212 222 | A | 1/2017 |
| DE | 10 2015 218 025 | A | 3/2017 |
| DE | 10 2016 205 794 | A | 10/2017 |
| DE | 102016211997 | A | 1/2018 |
| EP | 2 219 985 | A | 8/2010 |
| EP | 2 993 152 | B | 3/2016 |
| JP | H06191769 | A | 7/1994 |
| KR | 1020160138222 | A | 12/2016 |
| WO | 2009/074627 | A | 6/2009 |
| WO | 2013/041941 | A | 3/2013 |
| WO | 2015/144781 | A | 10/2015 |
| WO | 2017/010928 | A | 1/2017 |

* cited by examiner

HOLDING DEVICE

CROSS REFERENCE TO RELATED APPLICATIONS

This application is a U.S. National Stage Entry of International Patent Application Serial Number PCT/EP2018/050265, filed Jan. 5, 2018, which claims priority to German Patent Application No. DE 10 2017 202 405.4, filed Feb. 15, 2017, the entire contents of both of which are incorporated herein by reference.

FIELD

The present disclosure generally relates to a holding device for holding a rotary platform of an elevator system.

BACKGROUND

The invention is applicable to elevator systems with at least one elevator car, in particular with a plurality of elevator cars, which can be moved in a shaft by way of guide rails. At least one fixed first guide rail is fixedly arranged in a shaft and orientated in a first, in particular vertical, direction; at least one fixed second guide rail is fixedly orientated in a second, in particular horizontal, direction; at least one third guide rail which can be rotated with respect to the shaft is secured to the rotary platform and can be transferred between an orientation in the first direction and an orientation in the second direction. Such systems are in principle described in WO 2015/144781 A1 and in the German patent applications 10 2016 211 997.4 and 10 2015 218 025.5.

The securement of the rotary platform, to which the rotatable guide rail is secured, to the shaft poses a major challenge, as a large number of requirements must be taken into account. Among other requirements, the rotary platform should require as little installation space as possible. It should be noted here that shaft walls are generally designed to be vertical throughout for structural reasons. Niches in the shaft wall, which could in principle provide additional local installation space, are, however, undesirable and should be avoided. The axial space requirement of the holding device therefore determines the axial distance of the guide rails from the shaft wall over the entire shaft height. The larger this axial distance, the larger is the total unused shaft space, as viewed over the shaft height. This unused shaft space must be minimized by reducing the axial size of the rotary platform and all other modules involved.

At the same time, the exact orientation of the rotary platform in the shaft poses a major challenge, which must be met under the above-cited conditions. Thus, a need exists where the rotatable rails must be precisely orientated with the fixed rails in the respective rotary position over the entire service life.

DETAILED DESCRIPTION

Figure 1:
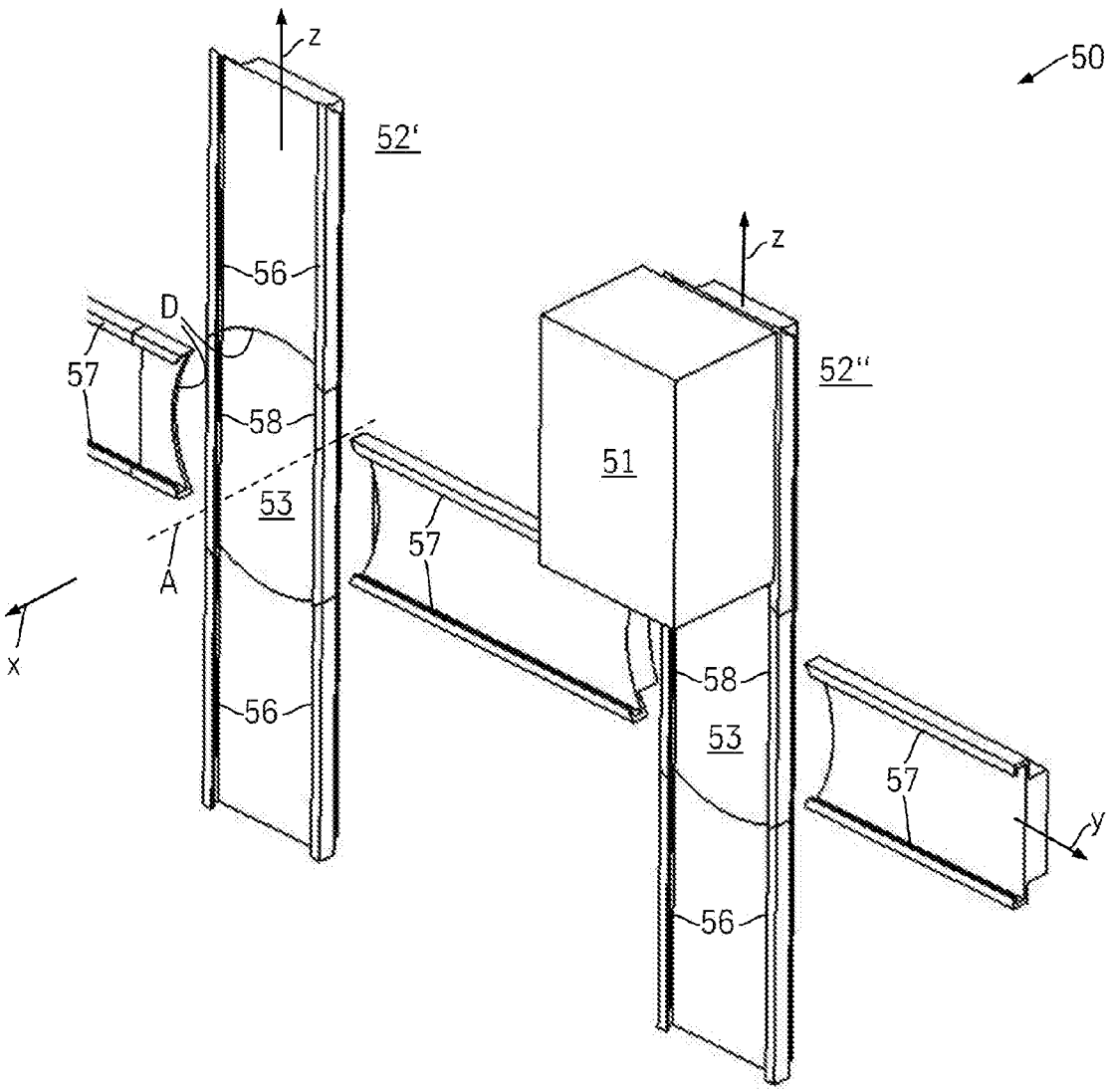
FIG. 1 is schematic view of the basic structure of an inventive elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention concerns a holding device for holding a rotary platform of an elevator system.

The inventive holding device comprises:

a shaft mounting for securing the holding device to the shaft;

a holding frame for the at least indirect securement of the rotary platform to the holding device, a first adjustment arrangement for adjusting the orientation of the holding frame with respect to the shaft mounting.

By the adjustment of the orientation (in what follows also referred to as the alignment), the local lateral position and the angular position of the holding frame are, in particular, adjusted. In particular, by means of the alignment the direction of the axis of rotation of a platform slewing bearing secured to the holding frame can be precisely orientated. The holding frame can therefore be manufactured with large tolerances and secured to the shaft with large tolerances; the subsequent orientation can nevertheless position the guide rails (guide rail sections) secured to the holding frame precisely to meet the requirements in the shaft. Thus, the holding frame can be designed comparatively cost-effectively as a welded structure.

The first adjustment arrangement preferably comprises at least three, in particular four, adjustment points. The spatial orientation can be defined by at least three adjustment points. Four adjustment points are preferred, as these can be arranged evenly in the four angular gaps between, as a rule, four guide rail lengths. In particular, the adjustment points are arranged radially outside the turning circle of the rotary platform and/or in particular are arranged partially overlapping axially with the turning circle. This results in a very good use of space, wherein the smallest possible distance between the rotatable guide rails and the shaft wall is made possible. Even when the rotary platform is installed, the adjustment points are easily accessible, and also allow orientation during maintenance work on the fully installed elevator system.

The adjustment point preferably comprises an adjustment base secured to the shaft mounting, and an adjustment support secured to the holding frame, wherein the position of the adjustment support relative to the adjustment base can be adjusted in at least three lateral degrees of freedom.

By alteration of the position of the adjustment supports in the context of the three degrees of freedom, the angular orientation of the holding frame can also be adjusted. For this purpose it is only necessary that the adjustment points are tolerant with respect to a slight tilting of the adjustment support with respect to the adjustment base. For a robust adjustability of the angular orientation it is advantageous if the adjustment points have a minimum distance of at least 1 m from one another. An explicit angular adjustability of the adjustment point is not absolutely necessary, in particular it is not explicitly provided at the adjustment point. In a further development, however, it is conceivable that a local angular adjustability is also provided at the adjustment point, for example by means of adjustable ball joints.

The holding frame preferably has a radially inner bearing housing for the accommodation of a platform slewing bearing. In particular, the bearing housing is arranged coaxially with the axis of rotation, and the bearing housing is arranged coaxially with, and overlapping radially with, the turning circle of the rotary platform.

The turning circle is understood essentially to be the peripheral surface of an imaginary body of rotation, which is created by the rotation of the rotary platform and the rotatable guide rails about the axis of rotation. This turning circle thus represents the outer boundary of the area required by the rotary platform, which must be kept free of all fixed components of the holding device. The turning circle can be defined by the position of the outer ends of the rotatable guide rails. Similarly, the turning circle can be defined by the radially inner ends of the fixed guide rails. The turning circle must be kept free of rigid parts.

At least one rail frame is preferably secured to the holding frame, the orientation of which rail frame with respect to the holding frame can be adjusted by way of a second adjustment arrangement. A plurality of fixed guide rails or guide rail sections can be secured to this rail frame. By virtue of the adjustability, a defined orientation can be generated between the fixed rails and the rotary platform, and thus the rotatable rails.

The inventive elevator system comprises a holding device of the above-cited type. In particular, a rotary platform is secured to the holding device.

The first adjustment arrangement is preferably arranged radially outside a turning circle of the rotary platform. In particular, the adjustment arrangement is arranged partially overlapping axially with the turning circle.

At least sections of fixed guide rails are preferably secured to the holding frame, wherein these are secured in particular by means of a common rail frame, the orientation of which with respect to the holding frame can be adjusted by way of a second adjustment arrangement. The rail frame must be orientated once with respect to the holding frame. The whole of the holding device including the rail frame must then be orientated with respect to the other guide rails in the shaft.

A platform slewing bearing for the mounting of the rotary platform is preferably installed on the holding frame, wherein the platform slewing bearing does not project axially beyond the holding frame in the direction of the rotary platform. By this means the requirements described above for a smallest possible axial installation space can be met.

The method for the installation of an elevator system comprises the following steps:

securement of a holding device of the above-cited type to the shaft, at the same time securement of the shaft mounting to the shaft;

The advantage now lies in particular in the fact that the holding device can first be roughly positioned in the shaft, and can there be brought into a precise orientation after securement. Easily accessible adjustment devices are available at the adjustment points for purposes of orientation.

The orientation and position of an axis of rotation of the rotary platform is preferably adjusted by means of the adjustment of the orientation of the holding frame. In particular, the axis of rotation can be orientated precisely at right angles to the direction of travel of the elevator car in the shaft.

Preferably before the holding device is secured to the shaft, a rail frame for the securement of at least sections of fixed guide rails is preferably secured to the holding frame. After the holding device has been secured to the shaft, at least sections of fixed guide rails are secured to the rail frame.

The rail frame is preferably orientated with respect to the rotary platform and/or the rotatable guide rails secured to the rotary platform.

The advantages cited with regard to the device or the method and further design possibilities can easily be transferred to the method or the device.

The invention enables a reliable and easy way of aligning the rails precisely to one another in the region of the rotary platform, and of constantly readjusting the orientation, even during operation.

FIG. 1 shows parts of an inventive elevator system 50. The elevator system 50 comprises fixed first guide rails 56, along which an elevator car 51 can be guided by means of a backpack mounting. The first guide rails 56 are vertically orientated in a first direction z and enable the elevator car 51 to be moved between different floors. Arrangements of such first guide rails 56 are arranged parallel to one another in two parallel shafts 52', 52", along which the elevator car 51 can be guided by means of a backpack mounting. Elevator cars in the one shaft 52 can move on the respective first guide rails 56 largely independently, and unhindered by elevator cars in the other shaft 52".

The elevator system 50 also comprises fixed second guide rails 57, along which the elevator car 51 can be guided by means of the backpack mounting. The second guide rails 57 are horizontally orientated in a second direction y, and enable the elevator car 51 to move within one floor. Furthermore, the second guide rails 57 connect the first guide rails 56 of the two shafts 52', 52" with one another. Thus the second guide rails 58 also serve to move the elevator car 51 between the two shafts 52', 52", for example, so as to carry out a modern paternoster operation.

The elevator car 51 can be transferred from the first guide rails 56 to the second guide rails 57, and vice versa, by way of third guide rails 58. The third guide rails 58 can be rotated with respect to an axis of rotation A, which is perpendicular to a y-z plane, which is spanned by the first and second guide rails 56, 57.

All the guide rails 56, 57, 58 are secured at least indirectly to at least one shaft wall of the shaft 52. The shaft wall defines a fixed reference system for the shaft. The term shaft wall also comprises alternatively a fixed frame structure of the shaft, which carries the guide rails. The rotatable third guide rails 58 are secured to a rotary platform 53. The rotary platform 53 is supported by a platform slewing bearing 60, which is not shown in FIG. 1 (see FIG. 2).

Such systems are in principle described in WO 2015/144781 A1 and in the German patent applications 10 2016 211 997.4 and 10 2015 218 025.5. In this context, 10 2016 205 794.4 describes in detail an arrangement with integrated platform slewing bearings and a drive unit for the rotation of the rotary platform, which can also be used in the context of the present invention to provide a mounting and a rotary drive for the rotary platform.

Figure 2:
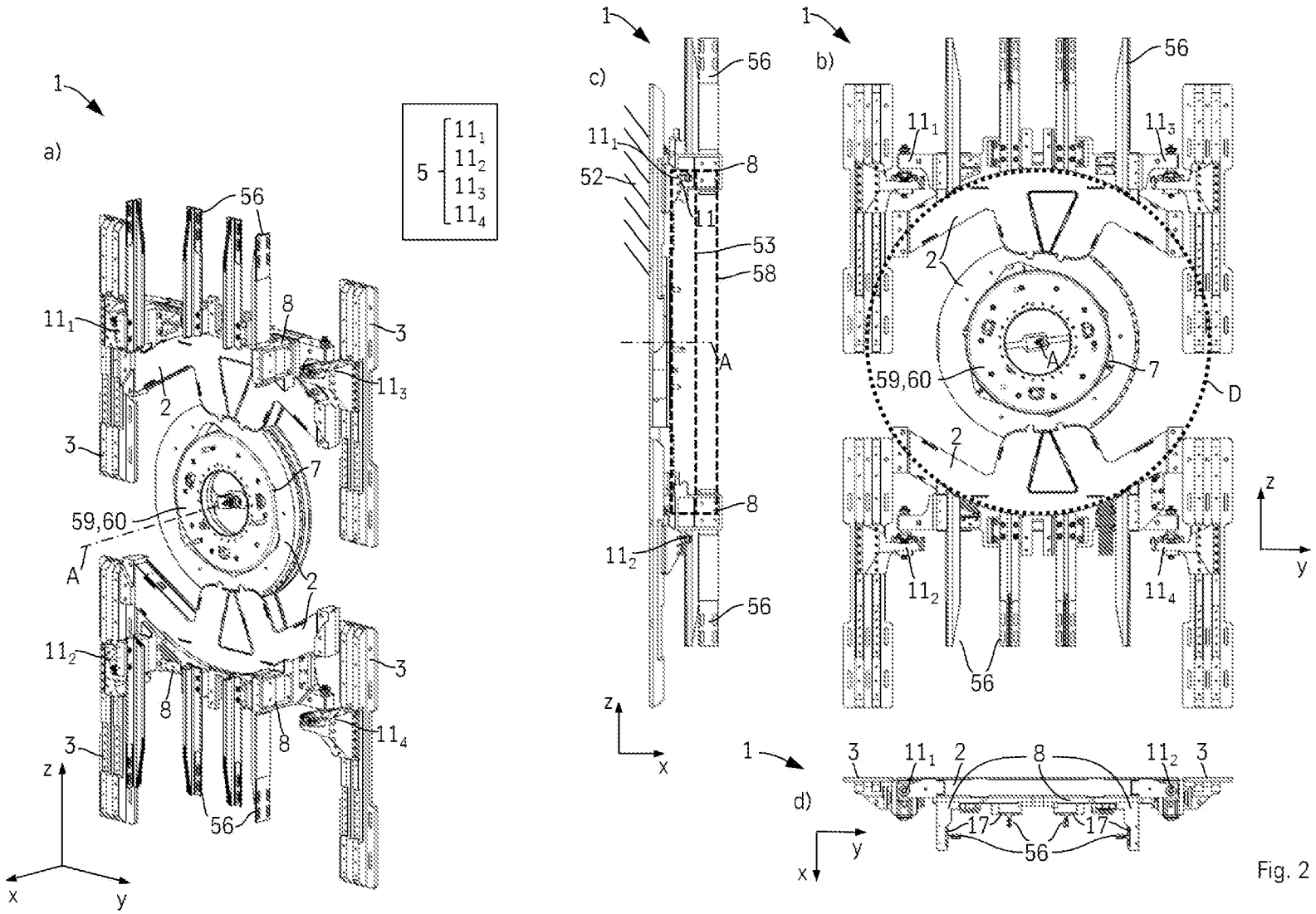
FIG. 2 is a detailed view of an inventive holding device in various views.

FIG. 2 shows an inventive holding device 1 with which the rotary platform 53 is held in the shaft. The holding device 1 comprises four shaft mountings 3, which are secured to the shaft 52. A holding frame 2 is installed on these shaft mountings 3. The orientation of the holding frame 2 with respect to the shaft mountings 3 can be adjusted by way of a first adjustment arrangement 5. The holding frame 2 comprises a radially inner bearing housing 7 for a platform slewing bearing 60. In the present case, the platform slewing bearing 60 is embodied together with a drive unit 59 in a common module.

A large number of installation space requirements must be observed with this holding device. Firstly it must be ensured that all fixed parts of the holding device 1 are arranged outside a turning circle D (see FIG. 1, 2*b*) of the rotary platform 53, including the rotatable guide rails 58. The smallest possible axial installation space between the rotary platform and the shaft wall must therefore be used for the mounting of the platform slewing bearing 60. This is because the larger this installation space, the larger is the axial distance of the rotary platform from the shaft wall. This in turn increases the distance of the rotatable third guide rails 58 from the shaft wall. Since the fixed guide rails 56, 57 must be orientated with the rotatable guide rails 58, the distance of the fixed guide rails 56, 57 from the shaft wall is therefore directly related to the axial extent of the holding frame and the platform slewing bearing. In order to make optimum use of space over the entire shaft height, the fixed guide rails should be mounted axially as close as possible to the shaft wall. The direction designations "axial" and "radial" always refer to the axis of rotation A.

Figure 3:
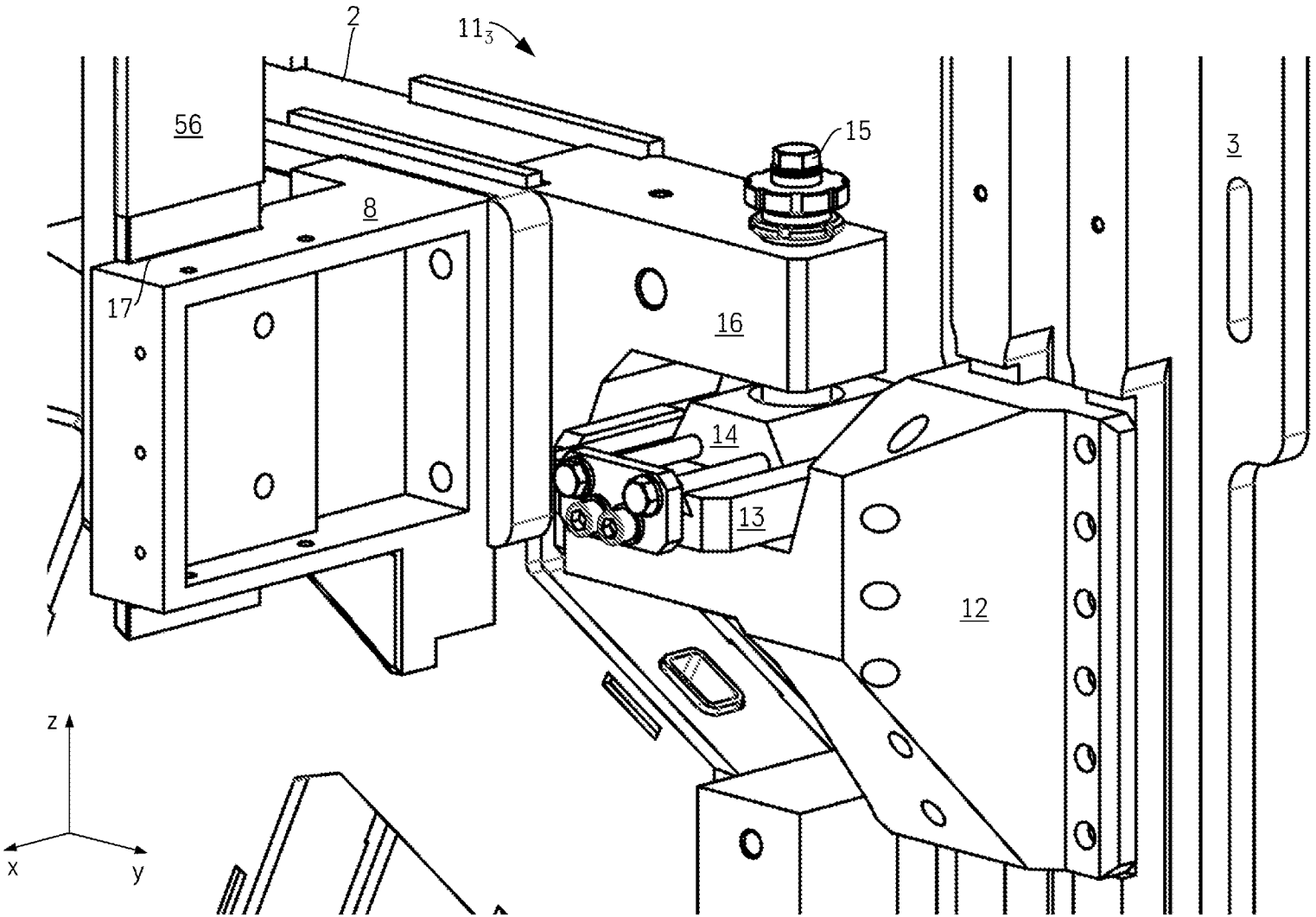
FIG. 3 is a perspective view in an enlarged detail of an adjustment point of the holding device in FIG. 2.

FIG. 3 shows the adjustment point $\mathbf{11}_3$ enlarged as a representative of all adjustment points. The adjustment point 11 comprises an adjustment base 12, which is secured to the shaft mounting 3 in a prescribed position. An adjustment support 16 is secured to the holding frame 2 in a prescribed position. In this design the adjustment support 16 is an integral component of the holding frame 2. The position of all adjustment supports 16 relative to the respective adjustment base 12 at the at least three (here four) adjustment points 11 defines the local position and orientation of the holding frame 2 in the shaft 52.

An adjustment rail 13 is held on the adjustment base 12 such that it can be displaced in the second direction y. An adjustment slide 14 is held on the adjustment rail 13 such that it can be displaced in a third direction x. An adjustment screw 15 is fitted to the adjustment slide 14 from above. The adjustment screw 15 is guided through a threaded hole in the adjustment support 16. The directions of the individual adjustment means 12-16 do not necessarily have to correlate with the directions of the fixed guide rails 56, 57.

As shown on the connection between the adjustment rail 13 and the adjustment slide 14, the displaceability can be implemented by way of a dovetail guide. Such a dovetail guide is also present between the adjustment base 12 and the adjustment rail 13, but is not visible in this representation.

By turning the adjustment screw 15, the adjustment support 16 can be raised or lowered in the first direction z with respect to the adjustment slide. The adjusted position of the adjustment support 16 relative to the adjustment base 12 is fixed after adjustment.

It can be seen that the position of the adjustment points 11 makes them easily accessible, even if the rotary platform 53 and the rotatable guide rails 58 are already installed. Here the adjustment points 11 are arranged radially outside the turning circle D (FIG. 2*b*). The adjustment points 11 and the rotary platform 53 can here be arranged overlapping axially. FIG. 2*c* shows the outlines 53, 58, dashed for clarity, of the rotary platform 53 and the rotatable guide rails 58.

At least one section of the first guide rails 56 is also secured to the holding frame 2. For this purpose, rail frames 8 are mounted on the holding frame 2. In the present case, a rail frame 8 is made up from a plurality of components, which, however, are precisely orientated with one another. A rail frame has a plurality of, in the present case four, guide rail system positions 17, orientated with one another in a defined manner (see FIGS. 2*d* and 3). These guide rail system positions 17 have defined contact surfaces for the guide rails. If the guide rail sections are correctly installed at the guide rail system positions 17, the guide rail sections are correctly orientated with one another. However, the guide rail sections secured to the holding frame are not yet correctly orientated with respect to the shaft and the guide rail sections secured to the shaft 52. For a correct positioning of the sections of the guide rails 56 secured to the holding frame 2 in the shaft, the holding frame 2 must be orientated with respect to the shaft 52.

The installation of the holding device 1 and the guide rails 56 is described in what follows.

No fixed guide rails 56, 57 or sections thereof are secured to the holding device 1 in the initial state. The rail frame 8 is firstly secured to the holding frame 2. By way of a second adjustment arrangement 6, the rail frame 8 is brought into a correct orientation with the holding frame 2.

Figure 4:
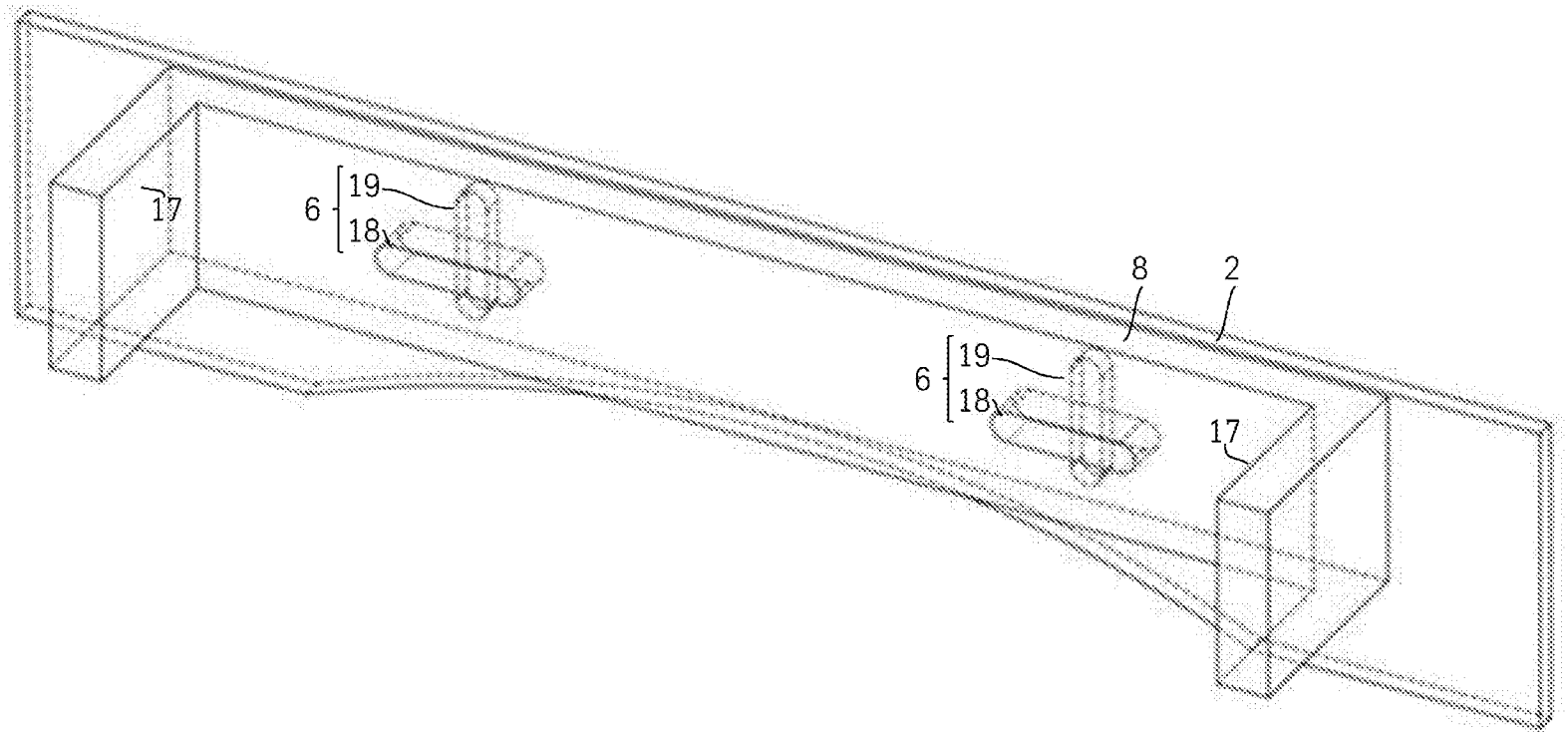
FIG. 4 is a schematic view of a second adjustment arrangement of the elevator system in FIG. 1.

This second adjustment arrangement 6 can comprise, for example, elongated holes 19, 18 on the holding frame 2 and on the rail frame 8, as shown schematically in FIG. 4 (FIG. 4 shows the holding frame 2 and the rail frame 8 in a simplified form). For a correct orientation it is, for example, required that the ends of the guide rails 56 are correctly orientated with respect to the axis of rotation A, so that, in operation, the ends of the fixed first guide rails 56 are precisely orientated with the rotatable third guide rails 58, which are secured by way of the rotary platform 53 and the bearing to the holding frame 2. A template or the original rotary platform 53 with rails 58 can be used for the adjustment of the rail frames 8; this is secured to the already installed slewing bearing 60. This template simulates the ends of the rotatable third guide rails 58. The rail frame 8 on the holding frame 2 is then adjusted with respect to these, possibly simulated, rotatable guide rails. The securement of the rail frame 8 to the holding frame 2 and its alignment with the latter is preferably carried out before the securement of the holding frame 2 to the shaft 52, since the second adjustment arrangement 6 is then even easier to access, however in principle the securement of the rail frames 8 to the holding frame 2 and its alignment with the latter is also conceivable if the holding frame 2 is already installed in the shaft 52.

To secure the holding device 1 to the shaft, the shaft mountings 3 are firstly secured to the shaft 52. This can be done by drilling holes or anchor rails into the shaft wall, inserting dowels or anchor bolts into these holes and then screwing the shaft mountings 3 to the dowels. For this purpose comparatively large tolerances can be observed.

The holding frame 2 is then installed onto the shaft mountings 3, initially in any orientation. If the rail frames 8 are not yet installed, these are now installed and orientated within the holding frame 2. The holding frame can now be orientated precisely by means of the first adjustment arrangement. The aim here is to ensure that the rail frames 8 are correctly exactly orientated with the desired course of the vertical guide rails 56 in the shaft. With this adjustment the orientation between the rail frames 8 and the holding frame 2 does not alter subsequently.

The adjusted orientations are then fixed by tightening appropriate screws. Operation can begin.

In the interests of clarity, the connection of the second guide rails to the holding frame 2 has not been described. This connection and the adjustment of the second guide rails takes place in an identical manner to the connection of the first guide rails as described above.

LIST OF REFERENCE SYMBOLS

1 Holding device
2 Holding frame for platform slewing bearing
3 Shaft mounting
5 First adjustment arrangement
6 Second adjustment arrangement
7 Radially inner bearing housing
8 Rail frame
11 Adjustment point
12 Adjustment base
13 Adjustment rail
14 Adjustment slide
15 Adjustment screw
16 Adjustment support
17 Guide rail system position on the rail frame
18 Elongated hole on the rail frame 8
19 Elongated hole on the holding frame 2
50 Elevator system
51 Elevator car
52 Shaft/shaft wall
53 Rotary platform
56 Fixed vertical first guide rail
57 Fixed horizontal second guide rail
58 Rotatable third guide rail
59 Drive unit
60 Platform slewing bearing
A Axis of rotation
D Turning circle

What is claimed is:

1. A holding device for holding a rotary platform of an elevator system, the elevator system comprising:
- an elevator car movable by way of guide rails;
- a fixed first guide rail fixedly arranged in a shaft and orientated in a first direction;
- a fixed second guide rail fixedly orientated in a second direction; and
- a third guide rail configured to rotate with respect to the shaft, is secured to the rotary platform and is configured to rotate between an orientation in the first direction and an orientation in the second direction;
- the holding device comprising:
  - a shaft mounting configured to secure the holding device to the shaft;
  - a holding frame configured to at least indirectly secure the rotary platform to the holding device; and
  - a first adjustment arrangement configured to adjust the orientation of the holding frame with respect to the shaft mounting.

2. The holding device of claim 1, wherein the first direction is vertical, and the second direction is horizontal.

3. The holding device of claim 1, wherein the first adjustment arrangement comprises a plurality of adjustment points arranged radially outside a turning circle of the rotary platform and partially overlapping axially with the turning circle.

4. The holding device of claim 3 including three or four adjustment points.

5. The holding device of claim 3, the adjustment point comprising an adjustment base secured to the shaft mounting, and an adjustment support secured to the holding frame, wherein the position of the adjustment support relative to the adjustment base is adjustable in at least three lateral degrees of freedom.

6. The holding device of claim 1, wherein the holding frame has a radially inner bearing housing for the accommodation of a platform slewing bearing, wherein the bearing housing and the turning circle of the rotary platform are arranged coaxially and overlapping radially.

7. The holding device of claim 1, comprising a rail frame secured to the holding frame configured to secure the first fixed guide rail, the orientation of which with respect to the holding frame can be adjusted by way of a second adjustment arrangement.

8. An elevator system comprising the holding device of claim 1, and a rotary platform, which is secured to the holding device.

9. The elevator system of claim 8, the first adjustment arrangement arranged radially outside a turning circle of the rotary platform and arranged partially overlapping axially with the turning circle.

10. The elevator system of claim 8, wherein at least sections of the fixed guide rails are secured to the holding frame, wherein these are secured by a common rail frame, the orientation of which with respect to the holding frame is adjustable by way of a second adjustment arrangement.

11. The elevator system of claim 8, comprising a platform slewing bearing installed on the holding frame and configured to mountably receive the rotary platform, wherein the platform slewing bearing does not project axially beyond the holding frame in the direction of the rotary platform.

12. A method for the installation of an elevator system, the elevator system comprising:
- an elevator car, which is movable by way of guide rails;
- a fixed first guide rail fixedly arranged in a shaft and orientated in a first direction;
- a fixed second guide rail fixedly orientated in a second direction;
- a third guide rail which is configured to rotate with respect to the shaft, and is secured to the rotary platform and is configured to rotate between an orientation in the first direction and an orientation in the second direction;
- the method comprising the following steps:
- securing a holding device to the shaft, the holding device comprising:
  - a shaft mounting configured to secure the holding device to the shaft;
  - a holding frame configured to at least indirectly secure the rotary platform to the holding device; and
  - a first adjustment arrangement configured to adjust the orientation of the holding frame with respect to the shaft mounting;
- securing, at the same time as said securing of the holding device, the shaft mounting to the shaft; and
- subsequently adjusting the orientation of the holding frame via the first adjustment arrangement.

13. The method of claim 12, further comprising adjusting, via said adjusting of the orientation of the holding frame, the orientation and position of an axis of rotation of the rotary platform.

14. The method of claim 12, wherein before the holding device is secured to the shaft, a rail frame for the securement of at least sections of fixed guide rails is secured to the holding frame, and after the holding device has been secured to the shaft, at least sections of the fixed guide rails are secured to the rail frame.

15. The method of claim 14, wherein the rail frame is orientated with respect to the holding frame via a second adjustment arrangement, after the rail frame has been secured to the holding frame, and before the at least sections of the fixed guide rails are secured to the rail frame.

* * * * *